US005456392A

United States Patent [19]

Majors

[11] Patent Number: 5,456,392

[45] Date of Patent: Oct. 10, 1995

[54] SOCK SORTING DEVICE

[76] Inventor: James W. Majors, 314 Lebanon Rd., SW., Ft. Payne, Ala. 35967

[21] Appl. No.: 252,453

[22] Filed: Jun. 1, 1994

[51] Int. Cl.[6] ..... A47G 25/90; B07C 5/344

[52] U.S. Cl. ..... 223/112; 209/571

[58] Field of Search ..... 223/111, 112, 223/75, 76, 77, 43; 112/DIG. 2, DIG. 3, 121.15; 209/571

[56] References Cited

U.S. PATENT DOCUMENTS

| | | | |
|---|---|---|---|
| 3,319,851 | 5/1967 | Horberg, Jr. | 223/112 |
| 3,420,196 | 1/1969 | Edwards et al. | 112/2 |
| 3,486,471 | 12/1969 | De Spain . | |
| 4,550,868 | 11/1985 | Hodges et al. | 223/112 |
| 4,576,276 | 3/1986 | Buckley et al. | 209/571 |
| 4,685,569 | 8/1987 | Osaki | 209/571 |
| 4,903,621 | 2/1990 | Hodges | 112/121 |
| 4,919,315 | 4/1990 | Nakano | 223/112 |
| 5,040,475 | 8/1991 | Fournier et al. | 223/43 |

*Primary Examiner*—Clifford D. Crowder
*Assistant Examiner*—Bibhu Mohanty
*Attorney, Agent, or Firm*—Needle & Rosenberg

[57] ABSTRACT

An adapter working in concert with a parent or host machine to divert socks of different styles or quality into separate collection containers, including a logic controller, a diverter assembly, at least two discharge conduits, and a manifold. The diverter assembly is pneumatically connected in series with the sock discharge outlet of the host machine. Depending upon a selection entered into the logic controller by an operator, a sock on a rotating turret on the host machine may be designated, at predetermined turret positions, to be of a particular style, or to be of second quality. The entry is entered into the logic controller, where it is remembered until the sock is ready to be everted and discharged. A index detection device is provided to indicate indexing of the turret to the logic controller. When the sock is in the discharge position, the logic controller operates the diverter valves in accordance with the choice or choices made earlier by the host machine operator, to cause the diverter valves to divert the sock into one of several conduits. The sock passes a detector in the selected conduit, which causes a counter for that style of sock (or for second quality socks) to increment, and which, after a time that permits the sock to be collected in a sock separator device, causes the vacuum in the selected conduit to be removed. Removal of the vacuum permits the sock to drop into a collection area or bin. The adapter permits uninterrupted seaming operations to occur, even though different styles and qualities of socks may be present in the run. The run need not be interrupted when a second quality sock or a sock of a different design is loaded or detected on the host machine.

8 Claims, 17 Drawing Sheets

DIVELBISS ADVANCED DOCUMENTATION LISTING

LADDER DIAGRAM SYMBOL KEY

TYPICAL LADDER DIAGRAM RUNG:

```
        {       Text enclosed in braces are comment lines.                    }
        {                                                                     }
        |bbbbbbb                                                  bbbbbbb     |
        |bbbbbbb                                                  bbbbbbb     |
        |bbbbbbb                                                  bbbbbbb     |
Rung    |cccccc                                                   cccccc      |Contacts
        |                                                                     |

aaa     +--] [-----------------------------------------------------------( )----+ eee
        |                                                                     |
        |  ddd                                                                |
```

LADDER DIAGRAM ELEMENT SYMBOL DESCRIPTIONS:

| | | | |
|---|---|---|---|
| --] [-- | Normally open contact. | -(MCR)- | Master control relay. |
| --] / [-- | Normally closed contact. | -(OEN)- | Output enable. |
| --( )-- | Energized coil. | -[CMP]- | Compare instruction. |
| --( / )-- | Deenergized coil. | -[SKP]- | Skip Instruction. |
| --(L)-- | Latched output. | -(END)- | End program. |
| --(U)-- | Unlatched output. | | |

LADDER DIAGRAM ELEMENT NOTATION DEFINITIONS:

aaa - Rung or line number. Additional lines belonging to the same rung are denoted with point numbers.

bbb - 21 character descripition of contacts and coils.

ccc - 6 character contact/coil address. Address descriptions:

| | | |
|---|---|---|
| External: | 1/00 | Real world input or output. |
| Internal: | CR | Control relay. |
| | TDPU | Time delay pickup timer. |
| | TDDO | Time delay dropout timer. |
| | RET | Retentive timer. |
| | PGEN | Pulse generator. |
| | CNTR | Counter. |
| | DR | Drum sequencer. |
| | SR | Shift register. |

ddd - Output coil reference. Locates the closest line or rung number where this contact is used as an output coil.

eee - Contact reference. Locates all lines or rung numbers where this output is used as a contact. A negative contact reference denotes a normally closed contact.

LISTING COMMANDS:

Listing commands are used to subtitle and page the listing. These commands are placed in the comment area.

.SUBTL - Subtitle line to precede each section.
.PAGE - Force beginning of new page.

FIG. 8A

DIVELBISS ADVANCED DOCUMENTATION LISTING

LADDER DIAGRAM

```
        |                                                                  |
Rung    | 1/04                                          CR-001             | Contacts
  1     +--] [-------------------------------------------------------(L)-- + 1
        |                                                                  |
        |                                                                  |
        | 1/05                                          CR-002             | Contacts
 .1     +--] [-------------------------------------------------------(2)-- + 2
        |                                                                  |
        |                                                                  |
        |                                                +--------------- + Contacts
 .2     +------------------------------------------------------------- + Reset      | 4
        |                                                |SR01             |
        |                                                |                 |
        | 1/03                                           |                 |
 .3     +--] [------------------------------------------------------------ + Clock
        |                                                |                 |
        |                                                |                 |
        |CR-001                                          |                 |
 .4     +---] [------------------------------------------------------------ + Data       +
        |     5                                          + -------------- +
        |                                                                  |
```

FIG. 8B

```
                                                                  |
Rung                                                  + ---------- + Contacts
 2   +------------------------------------------------ +  Reset   |  4
                                                      |SR02
                                                      |
     |1/03
 .1  +--] [------------------------------------------- +  Clock
     |
     |
     |CR-002
 .2  +--]  [------------------------------------------- +  Data
     |                                                 +---------- +
     |
Rung |
 3   |
     |
     |
     |
Rung |SR02-6                                      CR-003          | Contacts
 4   +--]  [-------------------------------------------------( ) ---- + -4,4
     |     2
     |
     |SR01-8      CR-003                          CR-004          | Contacts
 .1  +--]  [------------] / [-----------------------------------( ) ---- + 4
     |     1          4
     |
     |CR-003                                          1/03        |
 .2  +-- ]  [-------------------------------------------------( ) ---- +
     |     4                                                     |
```

FIG. 8C

DIVELBISS ADVANCED DOCUMENTATION LISTING

LADDER DIAGRAM

```
        |                                                                  |
        |CR-004                                                     1/04   |
.3      +---] [-----------------------------------------------------( ) -- +
        |   4                                                              |
        |                                                                  |
Rung    | 1/03                                          +-------------- + Contacts
5       +--] / [------------------------------------- +   Reset       | -5
        |                                               | TDD001        |
        |                                               | 0.1s          |
.1                                                      +-------------- +
        |                                                                  |
        | TDD001                                    CR-001               | Contacts
.2      +-----] / [--+-------------------------------------------(U)------ + 1
        |            |                                                     |
        |            |                                                     |
        |            |                                   CR-002            | Contacts
.3                   +-------------------------------------------(U)------- + 2
        |                                                                  |
        |                                                                  |
Rung    | 1/06                                          +-------------- + Contacts
6       +--] [------------------------------------- +   Reset       | 6
        |                                               | TDD002        |
        |                                               | 0.5s          |
.1                                                      +-------------- +
        |                                                                  |
```

FIG. 8D

DIVELBISS ADVANCED DOCUMENTATION LISTING

LADDER DIAGRAM

```
        |                                                          |
        1/07                                          +------------- + Contacts
.2      +---] [------------------------------------------------- +   Reset   | 6
                                                      |  TDD003
                                                      |   0.5s
.3                                                    +------------- +
        TDD002                                                1/06
.4      + ---] [--+------------------------------------------------- ( ) --- +
                6 |
                  |
                                                      CR-005 | Contacts
.5                +------------------------------------------------- ( ) --- + 7
        TDD003                                                1/05
.6      + ----] [--+------------------------------------------------- ( ) --- +
                6 |
                  |
                                                      CR-006 | Contacts
.7                +------------------------------------------------- ( ) --- + 7
Rung    CR-005                                                1/07
7       + --] [--+------------------------------------------------- ( ) --- +
                6 |
```

FIG. 8E

DIVELBISS ADVANCED DOCUMENTATION LISTING

LADDER DIAGRAM

```
     |          |                                  |
     |          |                                  |
     |          |                                  |
     | CR-006   |                                  |
.1   +---]  [--- +                                  |
     |      6                                      |
```

FIG. 8F

DIVELBISS ADVANCED DOCUMENTATION LISTING

INPUT CROSS REFERENCE

| ADDRESS | CONTACT RUNG | DESCRIPTION |
|---|---|---|
| 1/00 | -1, -2 | |
| 1/03 | 1, 2, -5 | |
| 1/04 | 1 | |
| 1/05 | 1 | |
| 1/06 | 6 | |
| 1/07 | 6 | |

FIG. 8G

DIVELBISS ADVANCED DOCUMENTATION LISTING

OUTPUT CROSS REFERENCE

| ADDRESS | COIL RUNG | DESCRIPTION |
|---|---|---|
| 1/03 | 4 | |
| 1/04 | 4 | |
| 1/05 | 6 | |
| 1/06 | 6 | |
| 1/07 | 7 | |

FIG. 8H

DIVELBISS ADVANCED DOCUMENTATION LISTING

CONTROL RELAY CROSS REFERENCE (CR-001 TO CR-107)

| ADDRESS | COIL / CONTACT RUNG | DESCRIPTION |
|---|---|---|
| CR-001 | 1, -5 / 1 | |
| CR-002 | 1, -5 / 2 | |
| CR-003 | 4 / -4, 4 | |
| CR-004 | 4 / 4 | |
| CR-005 | 6 / 7 | |
| CR-006 | 6 / 7 | |

FIG. 8I

DIVELBISS ADVANCED DOCUMENTATION LISTING

FUNCTION CROSS REFERENCE (CR-108 TO CR-491)

| FNC | NAME | DESCRIPTION COIL / CONTACT RUNG | PROT | CRs | CHARACTERISTICS |
|---|---|---|---|---|---|
| 1. | SR01 | 1 / 4 | | 108-119 | |
| 2. | SR02 | 2 / 4 | | 120-131 | |
| 3. | TDD001 | 5 / -5 | Oper | 132-143 | 0.1s |
| 4. | TDD002 | 6 / 6 | Oper | 144-155 | 0.5s |
| 5. | TDD003 | 6 / 6 | Oper | 156-167 | 0.5s |

FIG. 8J

SOCK SORTING DEVICE

BACKGROUND OF THE INVENTION

1. Field of the Invention

This invention relates to a device for sorting hosiery, and more particular to a pneumatic conveying system that interfaces with a multi-station sock sewing machine.

2. Description of the Prior Art

Conventionally, hosiery are knit in the form of elongated circular tubes with the toe end open. According to prior art, the stockings are delivered, in containers, to a seaming station. The operator of the seaming station then picks up the stockings and passes them through a sewing machine to trim and close the open toe, while the stockings are turned inside-out. Stockings are then delivered to an inspection station where they are visually inspected. After inspection, individual stockings are everted pneumatically through a hollow inspection form and delivered to a collection point. As delivered, they are in the rightside-out condition.

Some time ago, it was recognized that the repeated manual operations recited above increased the cost of hosiery by slowing down production and increasing the number of "seconds" due to imperfections caused by the inspection process, such as pulled threads. Thus, devices were developed in which a combination turning and inspection form is moveable from the inspection station to a sewing station to permit the toe of the stocking to be seamed while it remains on the form. However, the use of these devices were not entirely satisfactory because hosiery had to be inspected before the seaming operation, leading to some undetected defects. In some devices, the operator had to turn and inspect the hosiery on the form and wait for the form to deliver the hose to the seaming station and return before the next stocking can be placed on the form.

U.S. Pat. No. 3,486,471 (De Spain) describes an improved method and device wherein the hosiery is turned on a form at a first work station by a first operator, and then advanced on the form to a second work station where a second operator closes the toe while it remains on the form. The hosiery is then returned to the first work station, where the seamed hosiery is inspected by the first operator and subsequently everted through a hosiery receiving passage in the form. A duct system, connected to a source of pneumatic pressure differential, was provided to establish a flow of air through a hosiery receiving passage when they are at the first work station.

U.S. Pat. No. 3,420,196 (Edwards et at.) deserves a method and means for processing tubular fabric articles in which ends of the articles are dosed in an integrated operation that is capable of high-speed production that requires relatively little handling, reducing labor requirements and the danger of damage of the articles during handling. Tubular fabric articles are placed on forms at a receiving station, where an end of the article is closed while it remains on its form. The form advances through an end closing station, and articles are removed from the forms at a removal station. Articles may be inspected while they are on the forms at the receiving station, and everted as they are removed from the forms after end closing. This device comprises conveyor means that convey article carrying forms through the receiving end closing and removal stations, with the forms arranged for receiving open-ended articles at the receiving station such that open ends of the articles are disposed at the outer ends of the forms for closing of the article ends by closure means in the end closing station while the articles remain on the forms as the form advance through the end closing station to the removal station at which removal means remove the closed end articles from the forms.

The forms are hosiery inspecting and turning forms disposed to extend laterally from a conveyor means for ready access for mounting the hosiery articles thereon and to present the articles ends conveniently for horizontal feeding to the closure means, which is a sewing machine disposed adjacent the outer ends of the forms for feeding the toe ends of the articles through as the forms advance continuously through the end closing station. Inspection is accomplished on the inspecting and turning forms, where the toes are guided into the sewing machine. Then the toes are closed and the articles are everted and removed from the forms at the removal station. Two operators are required, one at the receiving station and another at the toe closing station.

However, prior art devices suffer from a number of disadvantages. For example, styles cannot be mixed; they must be fed into the system one style at a time. Because two or more styles are often produced at the same time in hosiery plants, it would be advantageous to be able to feed more than one style into the system at once, and to sort the different styles from each other and from seconds. Another disadvantage of the prior art devices is that seconds must be removed before the seaming operation, as there is no way to sort seconds or styles after they enter this operation. Moreover, the prior art devices for collecting and sorting socks are not fast enough for the ten-tube turrets used at today's speeds. It would thus be advantageous to provide a sock sorter that permitted a plurality of styles, as well as seconds, to enter the seaming operation while being sorted later. Furthermore, it would be advantageous to provide a system that has a plurality of separating and sorting functions. Thus, a hosiery factory could run at least two styles of hosiery at one time, while allowing seconds to be finished, sorted, and counted in the same run, at maximum efficiency, and with maximum return on salvaged seconds.

Today, machines such as "Detexomat" machines are used in the sock industry for the sole purpose of closing the toe of a sock. An operator loads a sock onto a tube. The operator also has the opportunity to remove the sock in the event the sock is not of first quality. However, when the operator removes the sock from the cycle, the machine must continue through its cycle empty. The sewing machine still runs, even though there are no socks to be sewn. While this is going on, the operator misses three socks because of the break in rhythm and removing the seconds sock from the tube. While each sock factory has its own system of handling seconds, generally the socks are collected, counted, and boxed. Meanwhile, a report must be made, and the socks must be tracked in the warehouse. (A box of sock seconds presently has a value of about $200.00 to $250.00.)

At some point, the accumulation of these seconds becomes a great problem. The problem is so great that an operator or operators must be taken off producing first quality production to seam the accumulated seconds. The operator replaces the sock on the tube, even though it was previously removed from the tube only a fraction of a second from the time it would have been seamed had it not been removed as a second.

Thus, although a satisfactory first quality sock line is produced by this method, the cost to produce the second quality line (in energy and manpower) is greater than the cost to produce the first quality line.

There is thus a need for an add-on device for a toe closer that can track a sock through the toe closer, and then, in accordance with a signal provided by the operator prior to the sewing step, direct the flow of the sock to an appropriate destination, in accordance with the determined quality of the sock and the style.

BRIEF DESCRIPTION OF THE INVENTION

There is thus provided, in accordance with the invention, a device designed to work in concert with a parent or host machine. The device comprises a logic controller, a diverter assembly, at least a first and a second discharge conduit, and a manifold. The logic controller is preferably a programmable logic controller having sufficient capacity to manage the desired number of options. The diverter assembly preferably comprises a pneumatic gate or flap valve arrangement allowing flow to go straight through or to be diverted out a side port. By stacking additional valves, additional options can be added. The diverter assembly valves may be operated by air valves and air cylinders that are activated by the logic controller. Alternately, solenoids, rotary solenoids, linear motors, or other similar means may be used to activate the diverter valve or valves.

The manifold comprises a device having a plurality of outlets equipped with a butterfly valve. When a photoswitch cell on a discharge conduit detects the presence of a sock being sent to a sock discharge device at the end of the discharge conduit, a signal is sent into a time delay, which is preferably within the logic controller although it may also be implemented in other conventional ways. Debounce circuitry is preferably employed to assure that only one pulse per sock is transmitted. The delayed signal causes a butterfly valve to close, allowing the sock to be released from the sock discharge or separator device, separating it from the source of vacuum, and allowing it to fall into a collection bin. Counters and alarms may be added to count the number of socks falling into each collection bin and to alert the operator when the desired number of socks has been collected in each bin.

It is thus a object of the invention to provide a device that provides for a plurality of configuration options, including the sorting of multiple styles.

It is thus a further object of the invention to provide a device that permits multiple styles of socks to be sorted from a single run of combined styles in a sock factory.

It is an additional object of the invention to provide a device and a method for sorting and counting first quality socks and seconds from a run without interrupting the run to remove the seconds prior to the seaming of the toes of the socks.

It is an additional object of the invention to provide a device and a method for sorting and counting first quality socks and seconds from a run of multiple styles of socks without interrupting the rhythm to remove the seconds prior to the seaming of the toes of the socks.

BRIEF DESCRIPTION OF THE DRAWINGS

FIG. 1A is a left side view and FIG. 1B is a partially cut-away front view of the host machine and adapter. Only a portion of the adapter is shown. The physical layout of the adapter may be altered to fit a particular workspace, and thus, the layout shown in this and the other figures is by example only.

FIG. 8A–8J show the ladder logic problem.

DETAILED DESCRIPTION OF THE PREFERRED EMBODIMENT

Figure 1B:
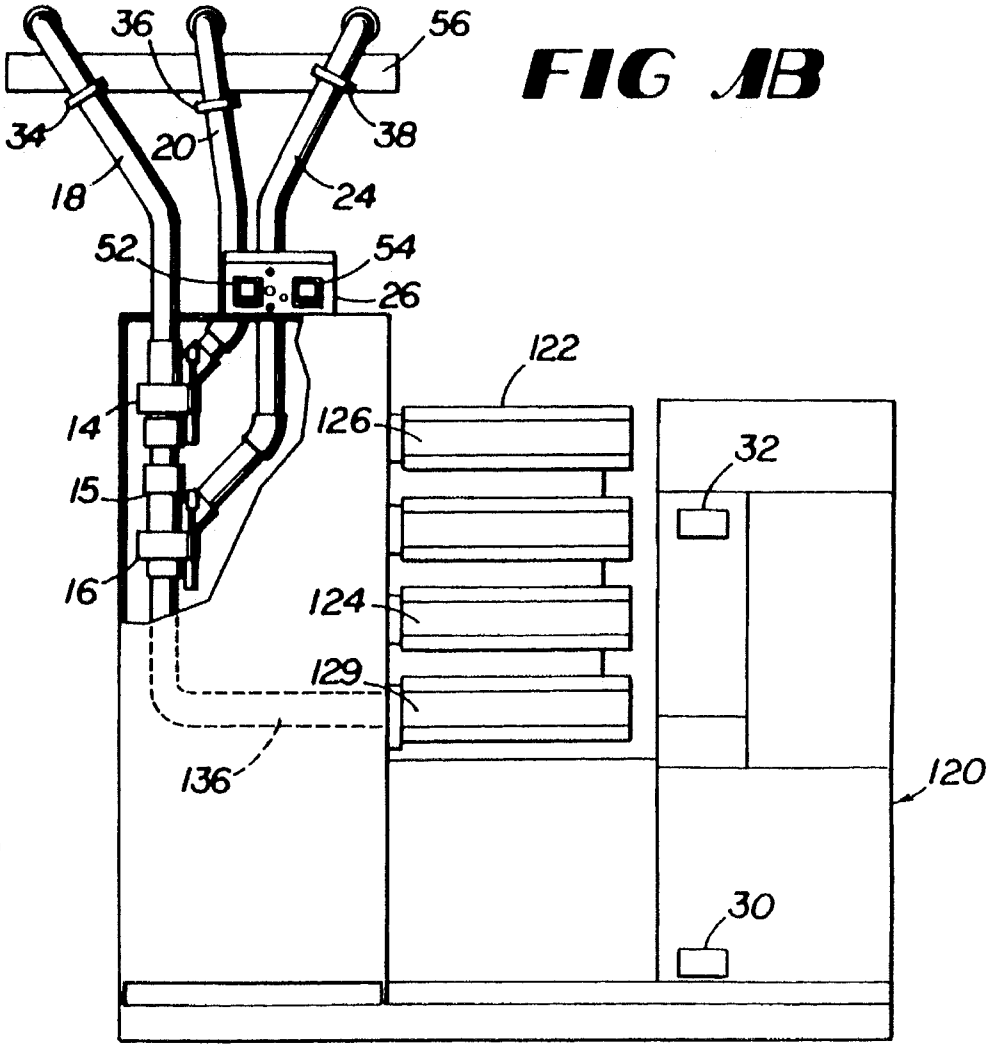
FIGS. 1A and 1B are views of a host machine to which an inventive adapter has been operatively installed.
Figure 1A:
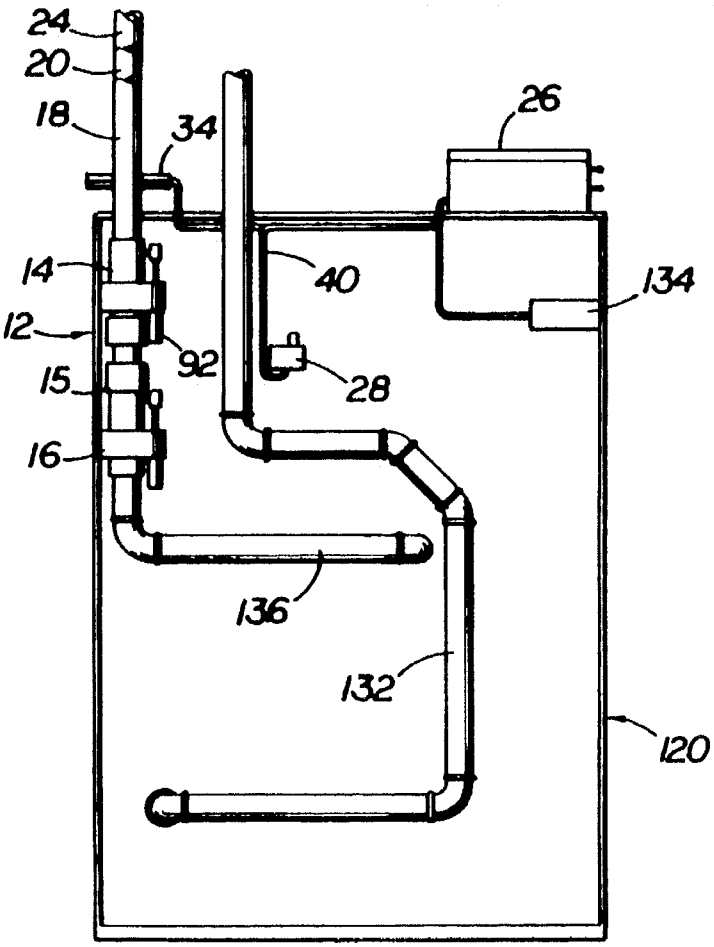

FIG. 1A is a left side view and FIG. 1B is a partially cut-away front view of a Detexomat Turn Sew machine, manufactured by Detexomat Machinery, Ltd., Wycombe, Buckinghamshire, England. A similar device is described in detail in U.S. Pat. No. 4,903,621 to Hodges et al., assigned to Detexomat Machinery, Ltd., Buckhamshire, England, the disclosure of which is incorporated into the present specification by reference. Host machine 120 has a rotating turret 122 comprising a plurality of positions, including a loading position 124 and an inspection position 126. A vacuum supply conduit 132, which is part of host machine 120, provides a source of vacuum for the discharge of socks on turret 122. Most modern facilities now have abandoned the vacuum pumps which reside within the host machine and instead, use a central unit (not shown), which reduces heat and noise. (The inventive system adapts to this system using a manifold 56, which not shown in FIG. 1A or FIG. 1B, but which described later.) Socks are discharged from the turret after sewing through sock discharge line 136.

In accordance with the invention, a sock discharge assembly 12 (best seen in FIG. 1A) is provided. A plurality of flow splitters 14, 16 are provided in the discharge assembly, preferably within the host machine, but they may also be installed remotely. The flow splitter provide pneumatic communication with discharge tubes 18, 20, and 24, depending upon the fluid connection established by the logic controller 26, which is also provided in accordance with the invention. The sock discharge assembly is preferably retrofitted inside a portion of the host machine 120, although it may alternately be provided outside the cabinet. It is to be understood that, while two flow splitters 14, 16 are provided in this embodiment, additional flow splitters could be provided, along with corresponding additional discharge conduits. The embodiment described here is adequate to sort and count two styles of socks, as well as separating and counting seconds. However, it will be recognized that, for sorting and counting n styles as well as separating seconds, n flow splitters are required, and n+1 discharge conduits.

Also provided in accordance with the invention are foot switch 30 and hand switch 32 which are electrically connected to logic controller 26. These switches are preferably located so that an operator of host machine 120 may conveniently operate switches 30 and 32.

Host machine 120 lacks the ability to run mixed styles and to complete seconds all in the same cycle. When adapted in accordance with the invention, host machine 120 can run multiple styles, and can complete socks found to have blemishes while still on the host machine 120. The different styles can be counted and separated into appropriate containers; seconds are also counted and separated into their own container. Thus, no secondary handling, storage, reverse flow, or secondary paper work to keep track of seconds or different styles is required. It will, of course, be recognized by one skilled in the art that the invention is not limited to the particular host machine 120 described herein, and can be readily adapted to other models of host machines.

Figure 2A:
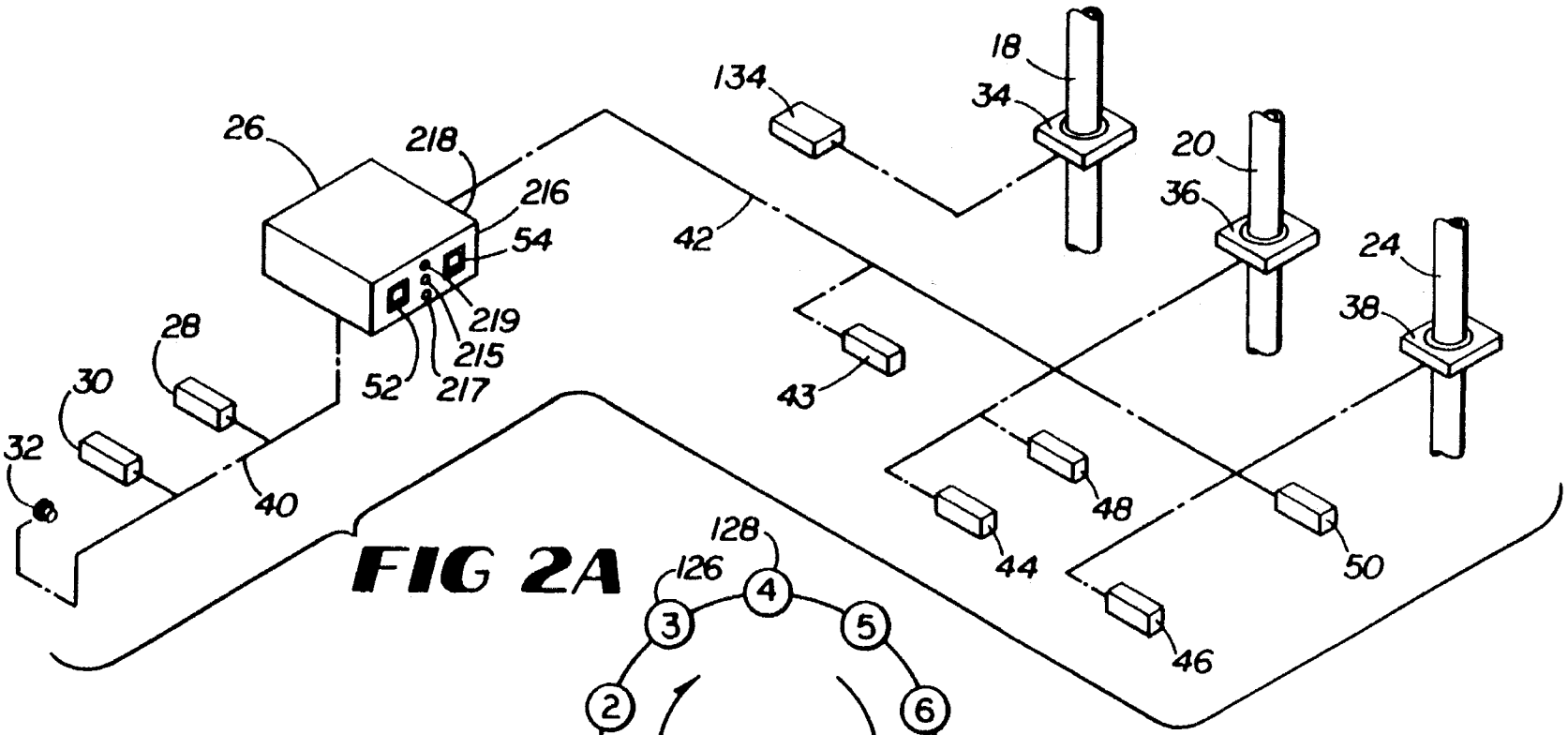
FIG. 2A is a schematic representation of the turret assembly of the host machine.

Host machine 120 has a work holding device comprising a rotatable turret 122 having ten working stations, schematically illustrated in FIG. 2A. Rotatable turret 122 rotates about a central axis. Each of the ten stations is equipped with a tube (not shown in FIG. 2A) which holds the sock while it is being rotated to the ten work stations. While the host machine 120 described in conjunction with this embodiment of the invention has ten turret positions, it will become clear that the invention can be easily adapted by one skilled in the art to a machine having a different number of turret positions.

To operate the host machine 122, the operator pulls a sock over the end of a tube in position 124, the first position of turret 122. The host machine 120 indexes on-tenth of a turn. When the first sock advances to position 126, corresponding to the third turret position, the operator inspects the sock. The sock is sewn in the fourth turret position 128, and unloaded in the ninth turret position 129. (Nothing of importance to the invention is done on the other turret positions, and the tenth turret position has no function.) As will be explained below, in the embodiment discussed here, the style selection is made by the operator when the sock is at the first turret position (i.e., position 124), while the decision to divert the finished sock to "seconds" is made at the third turret position (i.e., position 126).

Figure 2B:
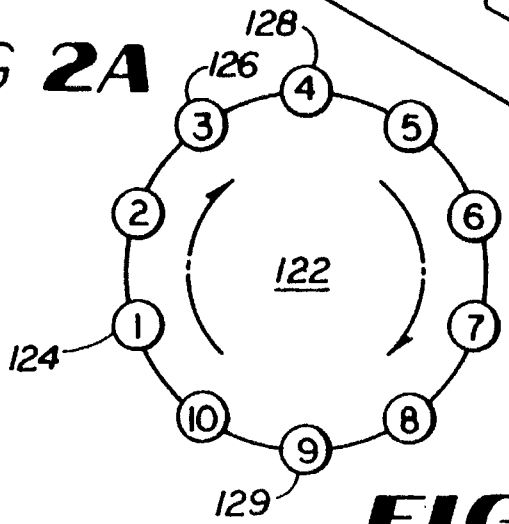
FIG. 2B is a electrical block diagram of a preferred embodiment of the invention.

FIG. 2B is a partial electrical block diagram of the inventive sock sorting device. An index detection means 28 a temporary contact foot switch 30, and a temporary contact hand switch 32 are connected to logic controller 26 via a cable harness 40. The index detection means 28 may be any means to detect the indexing of turret 122. Satisfactory devices that may be used as index detection means 28 include, but are not limited to, a limit switch, or any type of SPST normally open contact or proximity switch. Typically, foot switch 30 is used to sort one style of sock from another, while hand switch 32 is used to sort seconds from first quality socks. Logic controller 26 (preferably a model ICMBB-13 "Baby Bare Bones" single board expandable computer from Divelbiss Corp., Fredrictown, Ohio although other computer boards and even discrete logic could be used) is provided with a pair of counters 52, 54, which, together with a pre-existing counter 134 normally provided as a part of host machine 120, are actuated by photosensors 36, 38, and 34, in sock discharge conduits 20, 24, and 18, respectively, thereby keeping count of the number of each type of sock discharged from the invention. Counters 52 and 54 are preferably provided with a button pad (not shown) for resetting and for entering a value which may be compared with the current count to sound an alarm or buzzer 218 (which may be model "Squire 11000" counters from Veeder-Root, Curnee, Ill., which are used in a preferred embodiment of the invention) when a collection bin (not shown in FIG. 2B) has a predetermined number of socks in it. (Alternately, the predetermined number may be preprogrammed rather than entered by the operator.) The reset function may be provided with a key or other security device to ensure that the counts would be reset by a lead person rather than an operator. A panel switch 215 on logic controller 26 may be provided to run production through a single sock style in a manner to be explained later. Also provided in the preferred embodiment are an on-off switch 216, and a fuse 217 for electrical protection. A buzzer or alarm 218 may be provided for alerting an operator when a counter has reached a predetermined or preprogrammed value. Pneumatic diverter valves 44 and 46 are controlled by logic controller 26. Diverter valves 44 and 46 control socks in conduits 20 and 24 respectively, in a manner to be described below. Similarly, butterfly valves 48 and 50 also are controlled by logic controller 26 and are also associated with conduits 20 and 24, respectively, as will be seen below.

Figures 3A, 3B:
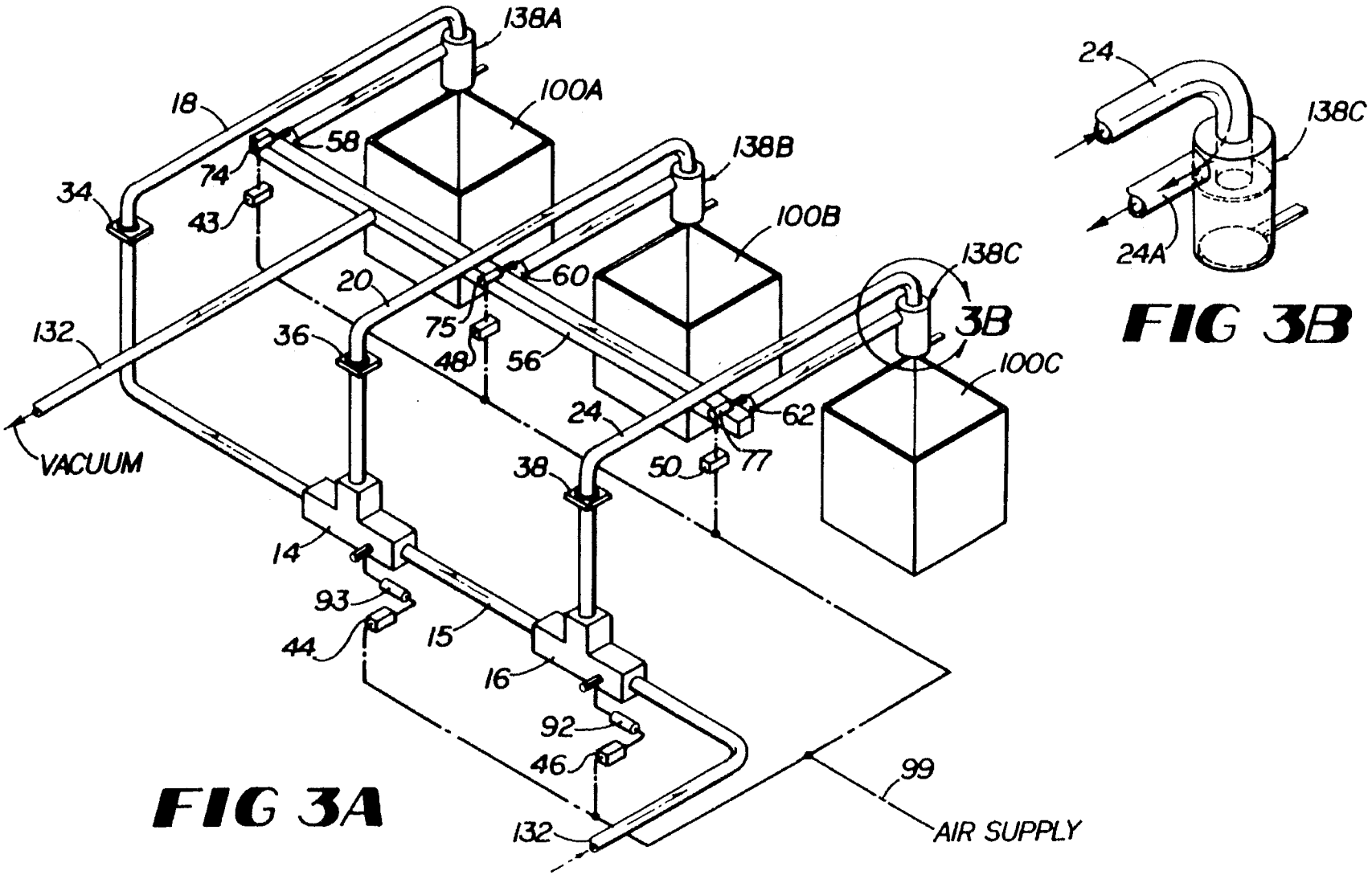
FIG. 3A is a schematic representation of the pneumatic flow through a preferred embodiment of the invention.
FIG. 3B is a detail representation of the sock separator device shown in FIG. 3A.

FIG. 3A is a schematic of the pneumatic flow through the inventive system. Air supply 99 provides an air source for the operation of valves 44, 46, 50, 48, and 43. The flow of vacuum through the conduits is generally indicated by arrows V. Vacuum is supplied via vacuum supply conduit 132. Sock discharge line 136, through which all socks everted from turret 122 (not shown in FIG. 3A) pass, enters valve 16, where, depending upon the state of pneumatic valve 46, socks are diverted either to discharge conduit 24 or intermediate conduit 15. Socks passing through intermediate conduit 15 next pass through a second valve 14, where, depending upon the state of pneumatic valve 44, they are either diverted into discharge conduit 20 or passed to discharge conduit 18. Depending upon the discharge conduit 18, 20, or 24 into which a sock is diverted, one of detectors 34, 36, or 38, respectively, detects the sock. Preferably, detectors 34, 36, and 38 are photoswitch detectors that can detect a sock through a clear portion of the respective discharge conduits, and that send a signal to controller 26 (not shown in FIG. 3A) so that the sock can be counted. The discharge conduits 18, 20, and 24 are each terminated in a sock separator drop box 138A, 138B, and 138C, respectively, of conventional design, such as those manufactured by Templex Corp. of High Point, N.C. (Drop box 138C is shown in more detail in FIG. 3B.) Vacuum for the drop boxes 138A, 138B, and 138C are provided by vacuum return conduits 18A, 20A, and 24A, respectively, each of which connect to a vacuum supply manifold 56. Between each of the vacuum return conduits 18A, 20A, and 24A and manifold 56, a separate butterfly valve 58, 60 and 62, respectively, is provided. Butterfly valves 58, 60, and 62 are connected to returns 18A, 20A, and 24A via drop boxes 138A, 138B, and 138C, respectively. Butterfly valves 58, 60, and 62 are controlled by pneumatic valves 43, 48, and 50.

Figure 4:
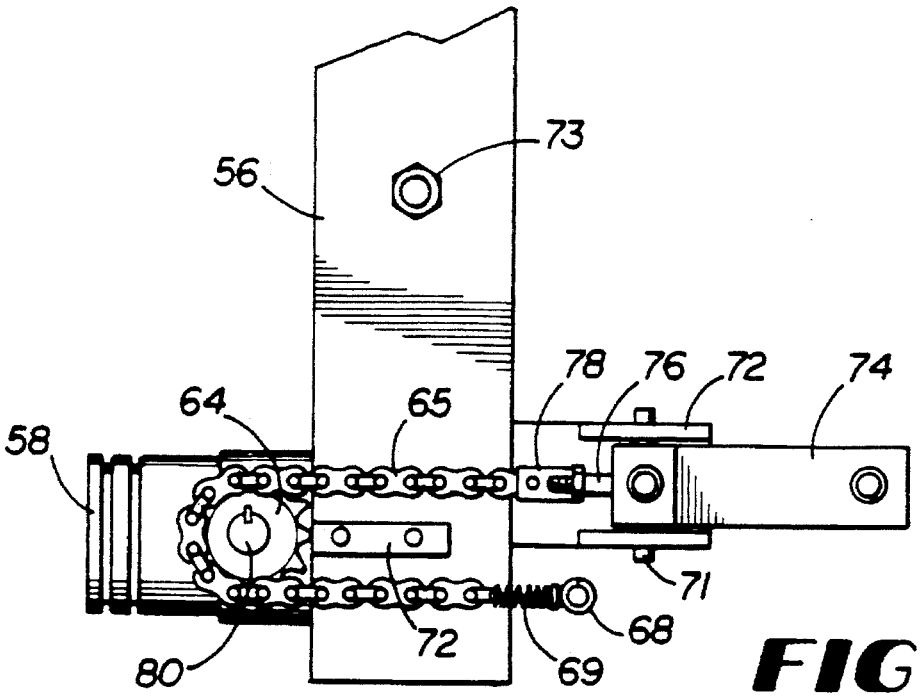
FIG. 4 is a top view of a manifold valve assembly employed in a preferred embodiment of the invention.
Figure 5:
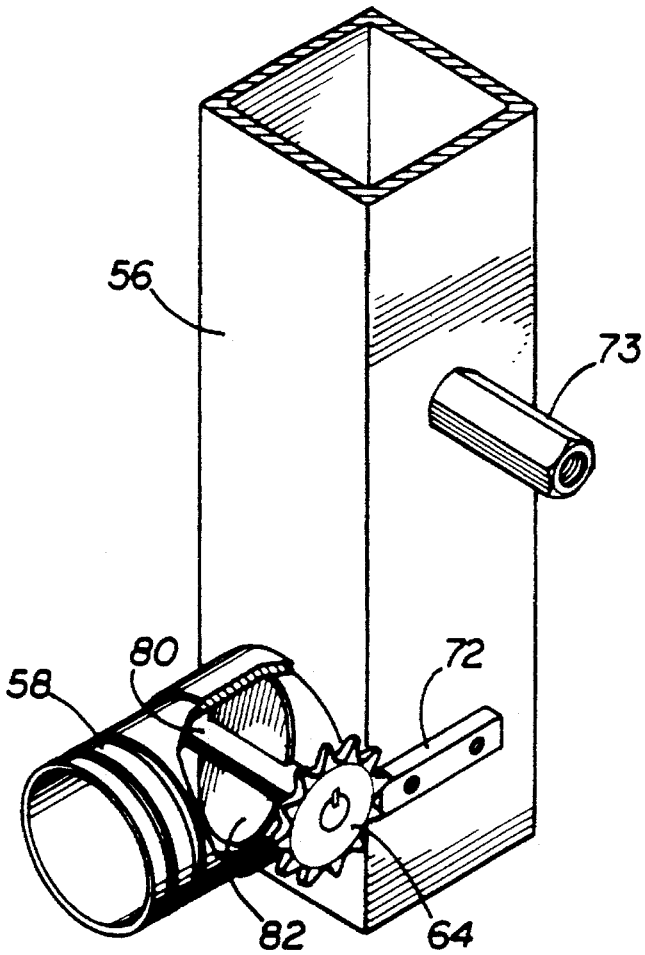
FIG. 5 is a partially cut-away perspective of the valve in FIG. 4 showing the operation of a butterfly valve.

FIG. 4 and FIG. 5 show detailed views of one of three manifold valve assemblies 58, 60, 62. Although only one manifold valve 58 is shown, the other valves 60, 62 are of similar construction. Butterfly valve disk 82 (shown only in a cut-away portion of FIG. 5) is operatively connected to valve shaft 80. Valve shaft 80 is rotated by a sprocket 64, which engages a chain 65 connected to a rod 76 of pneumatic cylinder 74 through a cylinder rod clevis 78. The other end of the chain is attached to a fixed position by spring assembly 68. Pneumatic cylinder 74 is controlled by a valve (not shown in FIG. 4 or FIG. 5), which is, in turn, controlled by a time-delayed signal from a sock detector 34, 36, or 38, the delay preferably being provided by logic controller 26. Outlet 59 is provided for mounting a vacuum return line 24A, which is controlled by manifold valve 58.

Figure 6:
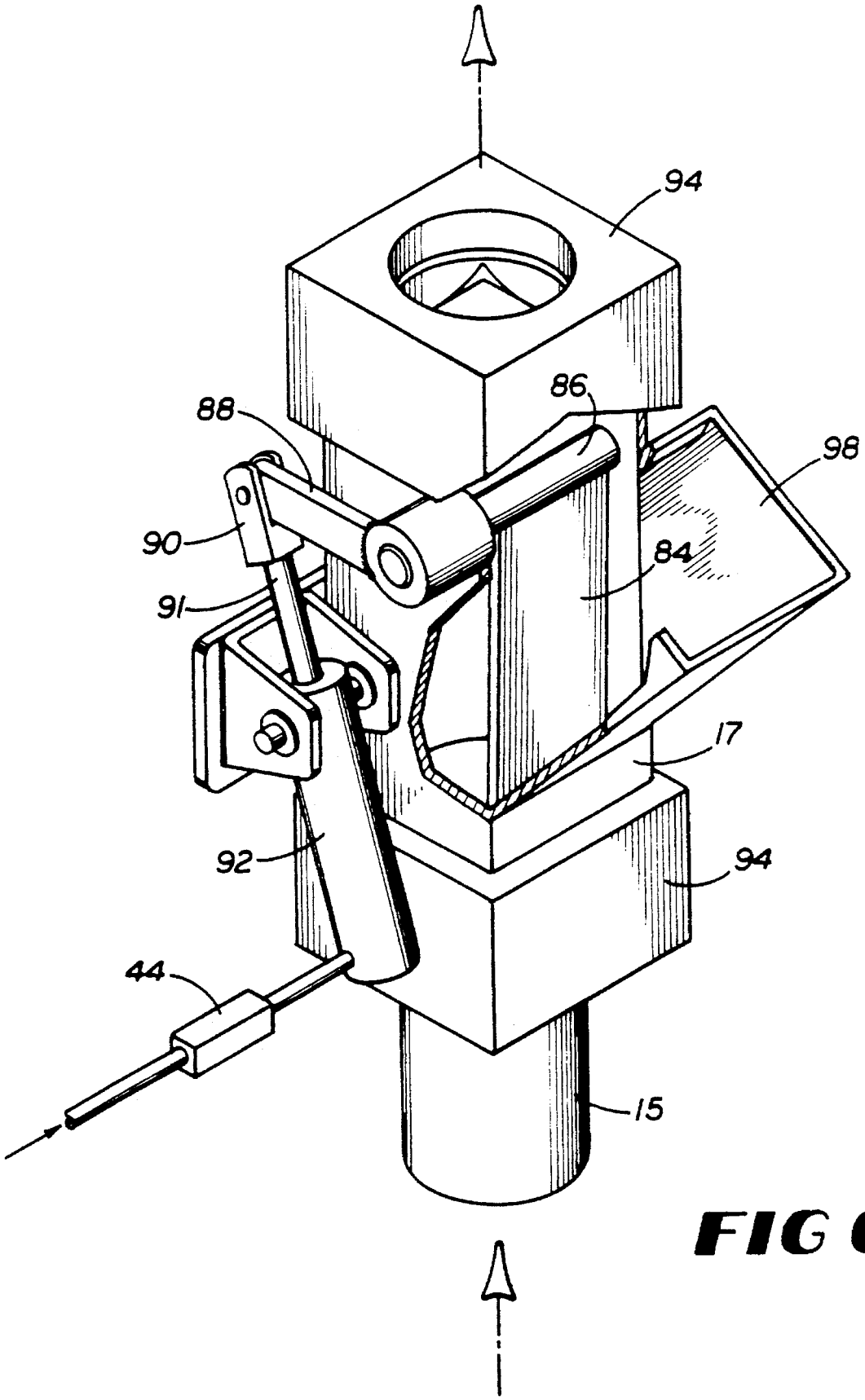
FIG. 6 is a partially cut-away perspective view of a swing gate valve used in the diverter assembly used in a preferred embodiment of the invention.

FIG. 6 shows a detailed view of one of valves 14 or 16, both of which are represented by the valve shown in FIG. 6. The valve comprises an adapter block 94 on either side of valve 14 (or equivalently, 16). These adapters serve to interconnect circular conduit, such as intermediate conduit 15, with square conduits such as is used in the body of valve 14. Valve 14 comprises a piece of such square conduit 17 between two adapter blocks 94. A branch 98 is provided off conduit 17. Normally, a gate 84 is in position as shown. However, gate 84 can be rotated into conduit 17 by pivoting around shaft 86, thereby deflecting a sock arriving from the bottom of FIG. 6 through bypass 98. Shaft 86 is rotated by a pneumatic cylinder 92 activated through an air source 99 controlled by an electrically controlled valve 44, which is itself controlled by logic controller 26 (not shown in FIG. 6). When shaft 86 is rotated, cylinder arm 91 moves cylinder clevis 90, causing bell crank 88 to rotate shaft 86.

It should be understood that pneumatic cylinders 92 and 74 described and their associated components may be replaced by other controllable assemblies, such as assemblies including solenoids, that can provide equivalent motions.

Figure 7A:
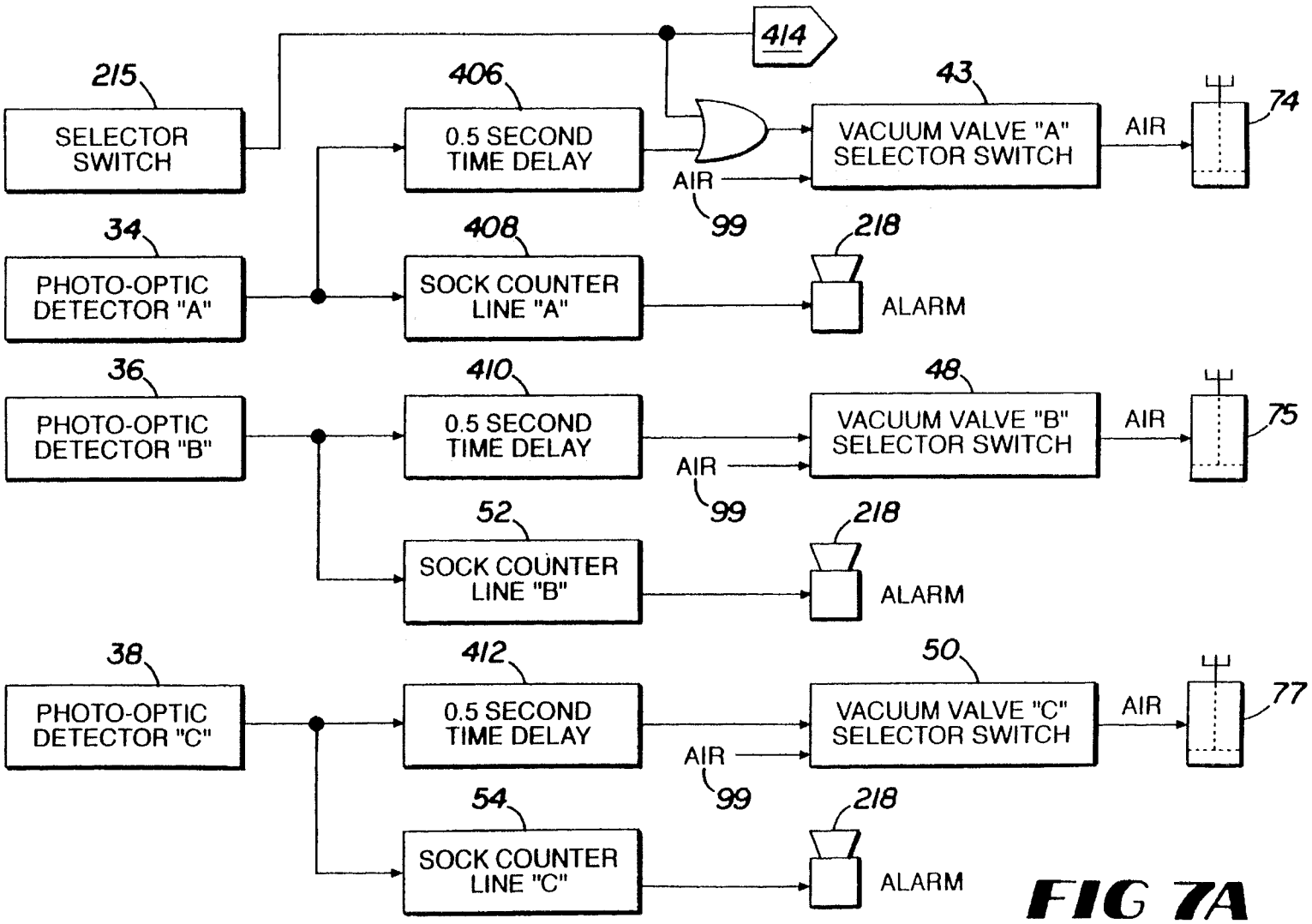
FIG. 7A and 7B are portions of a single logic block diagram indicating the operation of a logic controller used in the preferred embodiment of the invention.
Figure 7B:
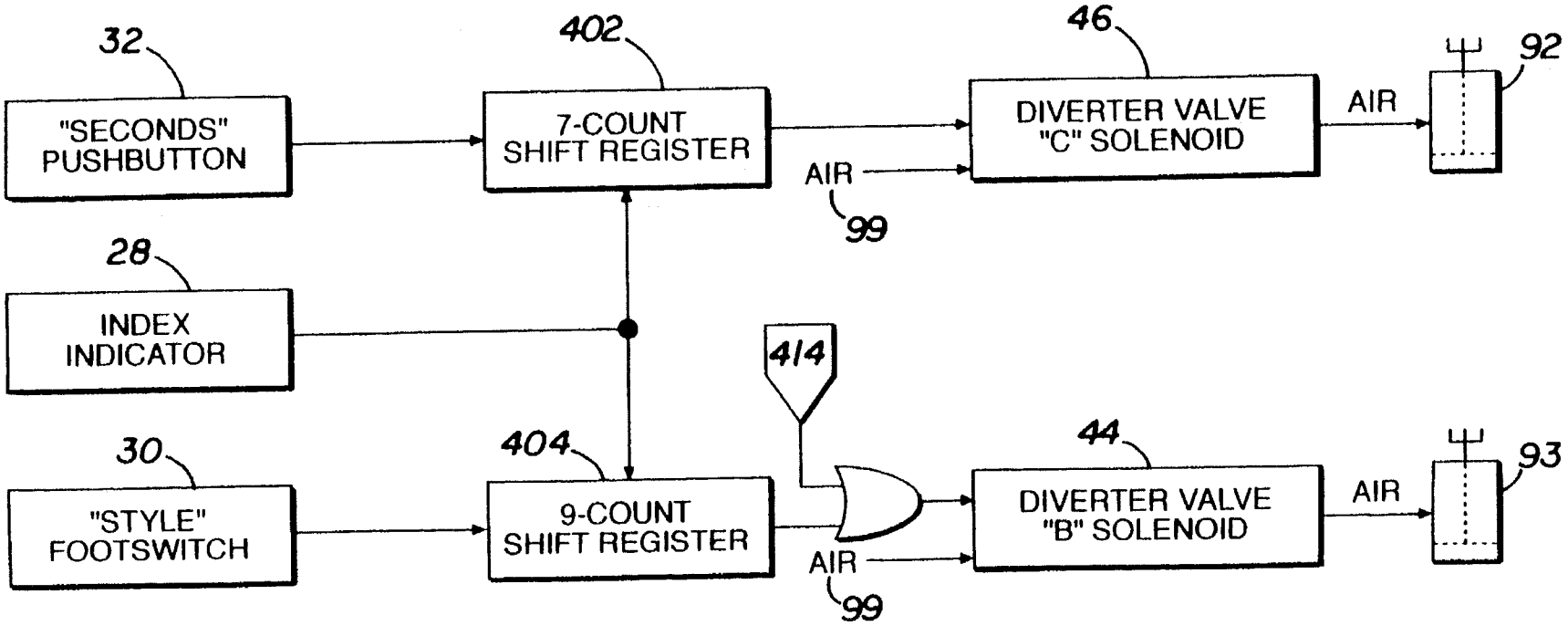

FIGS. 7A and 7B are logic diagrams indicating the operation of logic control 26 in the preferred embodiment. It is to be understood that the logic for logic controller 26 may be implemented either directly in hardware, or in software or firmware. For discussion purposes, let us consider four cases encompassing two different styles (e.g., style A and style B) and first and second quality socks of both styles.

Consider first the case in which a sock of style B is being seamed, and this sock is of second quality. In this case, the operator would operate both style change foot switch 30 and "seconds" pushbutton 32. Referring to FIG. 2A and FIG. 7B, as the sock is placed on the first turret position 124, the operator will depress the "style" foot switch 30, which enters a logical "1" (or any equivalent indication) into the first stage of 9count shift register 404. In the preferred embodiment, the style foot switch 30 need not be held down, as the first stage of shift register 404 latches in a "1" whenever the style foot switch is momentarily depressed. Each time turret 122 indexes, index indicator 28 outputs a signal that causes the 9-count shift register to shift its contents by one unit; thus, when the sock is rotated to turret position 2, the logical "1" in the first stage of the 9-count shift register 404 is shifted into the second stage of shift register 404, and the first stage is again ready to receive a 37 1"—which it will receive if and only if style foot switch 30 is pressed before the next indexing of turret 122. The next indexing operation moves the "1" in the second stage of shift register 404 into the third stage and places the sock in the third turret position 126, where the sock is inspected. Because in this example the sock is rejected to seconds, seconds pushbutton 32 is depressed, latching a logical "1" in the first stage of 7-count shift register 402. In the next indexing operation, the sock moves to the fourth turret position 128, where it is seamed. In addition, the "1" in 9-count shift register 404 moves to the fourth stage of that register and the "1" in 7-count shift register 402 moves to the second stage of that shift register. Each subsequent indexing operation advances the sock one turret position and the "1" in each shift register 402, 404 one position, until the sock is on the ninth turret position 129, and is ready to be everted and passed through sock discharge line 136. At that point, the "1" in 7-count shift register 402 is in its final position, causing shift register 402 to output a signal to diverter valve C solenoid 46, which operates pneumatic piston 92, causing valve 16 to divert the sock into discharge conduit 24. Similarly, the "1" in 9-count shift register 404 is in its final position, causing shift register 404 to output a signal to diverter valve B solenoid 44, which operates pneumatic piston 93, causing valve 14 to divert flow from conduit 15 into discharge conduit 20. However, since any sock entering sock discharge line 136 will be diverted into discharge conduit 24 rather than entering conduit 15, it will be seen that the "seconds" switch 32 in this embodiment has priority over the "style" switch 30, which is preferable in most commercial environments.

It will be readily apparent to one skilled in the art that the shift register lengths are selected to "remember" the status of a sock at a specific turret position until the sock is in a turret position from which it is evened and discharged. Thus, the length of the shift register may be modified to meet the requirements of other host machines, if necessary.

Referring to FIG. 3A, FIG. 3B, and FIG. 7A, the sock going through discharge conduit 24 passes through detector 38, which is a photoswitch detector in the preferred embodiment. At least a portion of discharge conduit 24 around which detector 38 is located is transparent, allowing a light beam to be interrupted when a sock passes through conduit 24 at the point at which detector 38 is located. When detector 38 detects a sock, the signal from detector 38 is "debounced" by conventional circuitry to ensure that a single indication is received from detector 38. The debounced signal from detector 38 causes sock counter 54 to advance one count. The count in sock counter 54 is then compared with a preselected and/or preprogrammed value, and alarm 218, which may be an audible alarm, is sounded if the count matches the preselected and/or preprogrammed value. (Alarm 218 is shown as three separate alarms, although its function can be supplied with only one alarm shared by each of the counters 408, 410, and 54. Note that alarm 218 may generally be connected to counter 54, which is part of host machine 120, through conventional circuitry.) Meanwhile, the sock continues in its path from detector 38 to sock separator drop box 138C. After a delay 412 (about 0.5 seconds in the preferred embodiment, the time delay, if any, being dependent upon the time it takes for a sock to pass from detector 38 to sock separator drop box 138C), a signal is sent to vacuum valve selector switch 50, which momentarily operates pneumatic cylinder 77, which closes butterfly valve 62, thus momentarily cutting the vacuum to drop box 138C. A door in sock separator drop box 138C, which is of a conventional design, holds the sock in a compartment within drop box 138C until the vacuum is cut off, which causes the door to open and allows the sock to drop from sock separator drop box 138C into collection box 100C, which holds second quality socks. When the vacuum resumes, the door in the sock separator drop box 138C closes, and it is ready to receive another sock.

If the sock had been of style A rather than style B, but still of second quality, the operator would not have pressed style foot switch 30 when the sock was on the first turret position, and thus a logical "0" would have been entered into 9-count shift register 404. As a result, when the sock was discharged from the ninth turret position, diverter valve solenoid 44 would not have been operated, and therefore, diverter valve 14 would have allowed passage from intermediate conduit 15 into sock discharge conduit 18. However, the sock would never reach intermediate conduit 15, because it would be diverted by diverter valve 16 into sock discharge conduit 24 as a result of the operator pressing the "seconds" pushbutton 32 at the appropriate time. Again, by operatively connecting the "seconds" switch to the diverter valve that is first in the path of the sock as it is discharged, the seconds switch 32 has priority over the style selection of style footswitch 30, and thus all seconds are diverted through discharge conduit 24.

Let us turn our attention now to socks of first quality. If the sock is of style "A", neither the seconds pushbutton 32 nor the style foot switch 30 will be depressed by the operator. Thus, "0" will be input to both shift registers 402, 404, and when the sock is ready to be everted and discharged at the ninth turret position 129, neither of the diverter valve solenoids ,14, 46 will be operated. Thus, diverter valve 16 will allow a sock in sock discharge conduit 136 to pass into intermediate conduit 15, and into diverter valve 14. Diverter valve 14 will allow the sock to pass into sock discharge conduit 18, and past detector 34, which is similar to detector 38. The detector 38 output is debounced and counted in a sock counter 408, which may be part of the host machine 120. When this count equals a predetermined or preprogrammed value, an alarm 218 is provided. This alarm corresponds to the predetermined or preprogrammed number of socks being sent to box 100A. Meanwhile, after a 0.5 second time delay 406, a signal is sent to vacuum valve selector switch 43, which operates pneumatic cylinder 74, causing valve 58 to cut off vacuum to sock collector drop box 138A, allowing the sock to drop into box 100A.

If the sock is of style "B," the operator will press style footswitch 30 when the sock is on the first turret position 124, thereby entering a logical "1" into 9-count shift register 404. The operator, however, will not press seconds pushbutton 32 when the sock is indexed to the third turret position 126, and thus a logical "0" will be entered into the 7-count shift register 402. The sock will be seamed in the fourth turret position 128. By the time the sock reaches the ninth turret position 129, it is ready to be everted and discharged. The "1" in 9-count shift register 404 will cause the diverter valve solenoid 44 and thus cylinder 93 to operate, diverting a sock passing from intermediate conduit 15 and into valve 14 to sock discharge conduit 20. Since a logical "0"0 was input to 7-count shift register 402 when the sock was on the third turret position 126, a "0" will be output from shift register 402 when the sock is on the ninth turret position 129 and diverter valve solenoid 46 will not operate when the sock is everted. Thus, the sock, which is discharged through sock discharge conduit 136, will pass through diverter valve 16 and into intermediate conduit 15. The sock will then pass into diverter valve 14, which is operated by solenoid 44 and cylinder 93 to divert the sock into sock discharge conduit 20. Similar to the other examples above, the sock is detected by detector 36, which causes counter 52 to increment, and, if appropriate, an alarm 218 to sound. Also, after a 0.5 second delay 410, vacuum valve selector switch 48 will operate, causing butterfly cylinder 75 to cause valve 60 to cut off vacuum to sock collector drop box 138B, allowing the sock to drop into box 100B.

In normal operation, only one sock at a time is passing through the sorting apparatus. Thus, indexing, which is controlled by the operator of host machine 120, is controlled so that a sock can complete its path into sock discharge conduit 136 and out of one of the sock collector drop boxes 138A, 138B, 138C before the turret 122 is indexed again. Normally, with sufficient vacuum and reasonably short sock conduit travel lengths, the maximum indexing rate will not be limited by the inventive apparatus, but rather by the rate at which the operator can operate host machine 120 and load socks on the first turret position 124. Because of the memory provided by the shift registers 402, 404, a turret 122 can have socks at each turret position from the first to the ninth (the tenth turret position is not used in the host machine 120 described), and each of the socks may be directed to the proper collection box 100A, 100B, 100C, without interrupting the rhythm of the operator.

A selector switch 216 may be provided to save vacuum, and also to allow operation when, for example, collection box 100A is filled, and it is acceptable to divert all further first quality socks to collection box 100B until collection box 100A is unloaded. Unlike foot switch 30, selector switch 216 is not a momentary contact switch. Referring to FIG. 7A, and FIG. 3A, the output of selector switch 216 is "or-ed" with the output of delay 406. Thus, if selector switch 216 is thrown, a signal will always be present at the input to vacuum valve selector switch 43, which will prevent vacuum from being supplied to sock collector drop box 138A and the associated conduit 18, thereby allowing a 33% savings of vacuum, whereby a lesser vacuum volume can operate the apparatus to permit selection between collection boxes 100B and 100C; i.e., first and second quality socks. Referring to FIG. 7A, FIG. 7B, and FIG. 3A, the signal from selector switch 215 (shown as coming from FIG. 7A by an indicator 414 showing the connection between parts on FIGS. 7A and 7B) is also "or-ed" with diverter valve solenoid 44, which, through air supply 99, operates pneumatic cylinder 93, which controls diverter valve 14. Thus, when switch 216 is thrown, all socks entering intermediate conduit 15 are diverted by diverter valve 14 into conduit 20, and thus into box 100B. Because diverter valve 16 is placed before diverter valve 14 in the path of the discharged socks, it is still possible to operate seconds pushbutton 32 to control the rejection of seconds, even when selector switch 216 is thrown. Selector switch 216 thus provides simplified operation when the sock styles have been presorted prior to seaming.

It is expected that logic controller 26 may preferably be provided as a single-board computer system, as described above. If the Divelbiss ICMBB-13 described above is used, an M2732AFI may be programmed in a Divelbiss "SMART" programmer with the ladder logic program following this description and inserted in the EPROM memory socket of the ICMBB-13 board to cause the logic controller 26 to operate in accordance with the invention.

It will thus be seen that the invention provides a pneumatic conveying system that interfaces with a multi-station sock seaming machine, and which simultaneously provides sorting capability for more than one style of sock and separation of seconds from first quality runs without interrupting a run and without requiring the removal of seconds for later seaming. Many modifications of the invention will be recognized as being within the capabilities of one skilled in the art. For example, by adding additional diverter valves and switches, it would be possible to expand the sorting capabilities of the invention. Moreover, it will be readily apparent to one skilled in the art that the lengths of the shift register memory elements may be adjusted to meet the requirements of different host machines having different numbers of turret positions or workstations, or different positions where socks are loaded, seamed, or discharged. It will also be recognized that a portion of the logic controller's functions may be embedded within a controller which may be supplied as a part of the host machine itself. Many other modifications will be apparent, and thus, the scope of the invention should not be considered as being limited only to the embodiment described above, but rather, the scope should be determined by reference to the claims at the end of this specification.

The ladder logic program referred to above is seen in FIGS. 8A–8J.

What is claimed is:

1. An adapter for an automatic hosiery toe closing machine of the type having a single pneumatic discharge path and a multiposition rotating turret upon which socks are placed, inspected, seamed, and collected, and for which a vacuum source is supplied;

the adapter comprising:

(a) a logic controller having (i) a first means for entering a first location for diverting a sock inspected on a first position of the multiposition rotating turret;

(ii) an index detector means for detecting when the multiposition rotating turret is rotated one index position;

(iii) a first means, responsive to the first means for entering and the index detector means, for storing the first location until a sock on the first position is indexed to a discharge position on the multiposition rotating turret;

(iv) a first location output, responsive to the first storage means, for outputting a signal corresponding to the first location when the inspected sock is indexed to a discharge position on the multiposition rotating turret;

(b) a diverter assembly comprising a first diverter valve operatively coupled to the logic controller and having (i) an inlet coupled to the sock discharge path;

(ii) a first outlet; and (iii) a second outlet;

the coupling of the inlet to the first or the second outlet selected by a signal from the first location output of the logic controller;

(c) a first discharge conduit having (i) a first end coupled to the first outlet of the diverter assembly, (ii) a second end having a first means for separating a sock from a source of vacuum, and (iii) a first detection means disposed between the first and the second ends of the first discharge conduit for detecting the presence of a sock passing through the first discharge conduit and for generating a first detection signal;

(d) a second discharge conduit having (i) a first end coupled to the second outlet of the diverter assembly, (ii) a second end having a second means for separating a sock from a source of vacuum, and (iii) a second detection means disposed between the first and second ends of the second discharge conduit for detecting the presence of a sock passing through the second discharge conduit and for generating a second detection signal;

and (e) a manifold pneumatically coupled to the first and second means for separating a sock from a source of vacuum, and having (i) a first valve responsive to the first detection signal and operatively coupled to the first means for separating a sock from a source of vacuum so that the vacuum source is decoupled from the first separating means after a sock is detected by the first detection means, allowing the sock detected by the first detection means to drop into a first collection area; and (ii) a second valve responsive to the second detection signal and operatively coupled to the second means for separating a sock from a source of vacuum so that the vacuum source is decoupled from the second separating means after a sock is detected by the second detection means, allowing the sock detected by the second detection means to drop into a second collection area.

2. An adapter for an automatic hosiery toe closing machine of the type having a single pneumatic discharge path and a multiposition rotating turret upon which socks are placed, inspected, seamed, and collected, and for which a vacuum source is supplied;

the adapter comprising:

(a) a logic controller having (i) a first means for entering a first location for diverting a sock inspected on a first position of the multiposition rotating turret;

(ii) a second means for entering a second location for diverting a sock inspected on a second position of the multiposition rotating turret;

(iii) an index detector means for detecting when the multiposition rotating turret is rotated one position;

(iv) a first means, responsive to the first means for entering and the index detector means, for storing the first location until a sock on the first position is indexed to a discharge position on the multiposition rotating turret;

(v) a second means, responsive to the second means for entering and the index detector means, for storing the second location until a sock on the second position is indexed to a discharge position on the multiposition rotating turret;

(vi) a first location output, responsive to the first storage means, for outputting a signal corresponding to the first location when the inspected sock is indexed to a discharge position on the multiposition rotating turret;

(vii) a second location output, responsive to the second storage means, for outputting a signal corresponding to the second location when the inspected sock is indexed to a discharge position on the multiposition rotating turret;

(b) a diverter assembly comprising (i) a first diverter valve operatively coupled to the logic controller and having an inlet coupled to the sock discharge path, a first inlet, and a first outlet and a second outlet, the coupling of the inlet of the first diverter valve to the first or the second outlet of the first diverter valve responsive to a signal from the first location output of the logic controller;

(ii) a second diverter valve operatively coupled to the logic controller and having an inlet coupled to the second outlet of the first discharge valve, and also having a first outlet and a second outlet, the coupling of the inlet of the second diverter valve to the first or the second outlet of the second diverter valve responsive to a signal from the second location output of the logic controller;

(c) a first discharge conduit having (i) a first end coupled to the first outlet of the first diverter valve, (ii) a second end having a first means for separating a sock from a source of vacuum, and (iii) a first detection means disposed between the first and the second ends of the first discharge conduit for detecting the presence of a sock passing through the first discharge conduit and for generating a first detection signal;

(d) a second discharge conduit having (i) a first end coupled to the first outlet of the second diverter valve, (ii) a second end having a second means for separating a sock from a source of vacuum, and (iii) a second detection means disposed between the first and second ends of the second discharge conduit for detecting the presence of a sock passing through the second discharge conduit and for generating a second detection signal;

(e) a third discharge conduit having (i) a first end coupled to the second outlet of the second diverter valve;

(ii) a second end having a third means for separating a sock from a source of vacuum, and (iii) a third detection means disposed between the first and second ends of the third discharge conduit for detecting the presence of a sock passing through the third discharge conduit and for generating a third detection signal;

and (f) a manifold pneumatically coupled to the first, the second, and the third means for separating a sock from a source of vacuum, and having (i) a first valve responsive to the first detection signal and operatively coupled to the first means for separating a sock from a source of vacuum so that the vacuum source is decoupled from the first separating means after a sock is detected by the first detection means, allowing the sock detected by the first detection means to drop into a first collection area; and (ii) a second valve responsive to the second detection signal and operatively coupled to the second means for separating a sock from a source of vacuum so that the vacuum source is decoupled from the second separating means after a sock is detected by the second detection means, allowing the sock detected by the second detection means to drop into a second collection area;

(iii) a third valve responsive to the third detection signal and operatively coupled to the third means for separating a sock from a source of vacuum so that the vacuum source is decoupled from the third separating means after a sock is detected by the third detection means, allowing the sock detected by the third detection means to drop into a third collection area.

3. The adapter of claim 2, and further comprising means coupled to at least one of the first, second, and third detection means for counting socks diverted to a corresponding location.

4. The adapter of claim 3, and further comprising means for resetting the counting means, and means responsive to the counting means for generating an alarm indicating that a predetermined number of socks has been delivered to the corresponding location.

5. The adapter of claim 2, and further comprising a selector switch operatively coupled to the second diverter valve, and the second diverter valve is also responsive to the position of the selector switch to override the signal from the second location output of the logic controller when the selector switch is in a selected position.

6. The adapter of claim 2, wherein the diverter valves are operated by pneumatic valves, which are controlled by solenoids electrically coupled to the respective location outputs of the logic controller.

7. The adapter of claim 2, wherein the tint, second, and third manifold valves are operated by pneumatic valves, which are controlled by solenoids electrically coupled to the first, second, and third means for detecting.

8. The adapter of claim 2 and further comprising means for delaying the operation of the first, second, and third valves to allow socks detected by the respective detection means sufficient time to reach the respective separating means.

* * * * *